US011194270B2

(12) United States Patent
Ando

(10) Patent No.: US 11,194,270 B2
(45) Date of Patent: Dec. 7, 2021

(54) IMAGE FORMING APPARATUS AND TRANSFER DEVICE COMPRISING FIRST AND SECOND TRANSFER ROLLERS

(71) Applicant: KYOCERA Document Solutions Inc., Osaka (JP)

(72) Inventor: Satoshi Ando, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/209,557

(22) Filed: Mar. 23, 2021

(65) Prior Publication Data

US 2021/0302878 A1 Sep. 30, 2021

(30) Foreign Application Priority Data

Mar. 24, 2020 (JP) ..... JP2020-052724

(51) Int. Cl.
*G03G 15/16* (2006.01)

(52) U.S. Cl.
CPC ..... *G03G 15/1675* (2013.01); *G03G 15/1615* (2013.01); *G03G 15/1685* (2013.01); *G03G 15/167* (2013.01); *G03G 15/1665* (2013.01)

(58) Field of Classification Search
CPC ..... G03G 15/1615; G03G 15/1685; G03G 15/167; G03G 15/1665
See application file for complete search history.

(56) References Cited

U.S. PATENT DOCUMENTS 10,678,175 B2 * 6/2020 Tabata ..... G03G 15/1605
2017/0255133 A1 9/2017 Kubota et al.

FOREIGN PATENT DOCUMENTS

JP 2017156653 A 9/2017

* cited by examiner

*Primary Examiner* — Arlene Heredia
(74) *Attorney, Agent, or Firm* — Alleman Hall Creasman & Tuttle LLP

(57) ABSTRACT

When a first roller is in an operation state, a driving device displaces a second displacement member in a first direction. This displaces a second locking portion of a slide portion to a position to lock a first projection portion of a first roller support member and a second projection portion of a second roller support member, while a first displacement member is held at a first position. The driving device further displaces the second displacement member in a second direction and stops the second displacement member. This allows the first displacement member to be displaced from the first position to a second position, and the second displacement member is further displaced and stopped at a position where the second projection portion is inserted in the recessed portion of the slide portion. This allows a second roller to enter an operation state.

6 Claims, 7 Drawing Sheets

IMAGE FORMING APPARATUS AND TRANSFER DEVICE COMPRISING FIRST AND SECOND TRANSFER ROLLERS

INCORPORATION BY REFERENCE

This application is based upon and claims the benefit of priority from the corresponding Japanese Patent Application No. 2020-052724 filed on Mar. 24, 2020, the entire contents of which are incorporated herein by reference.

BACKGROUND

The present disclosure relates to a transfer device configured to transfer a toner image to a sheet, and relates to an image forming apparatus including the transfer device.

In an electrophotographic image forming apparatus, a transfer device includes a transfer roller which forms a nip between itself and an image carrier such as an intermediate transfer belt. The transfer roller transfers a toner image from a surface of the image carrier to a sheet that passes through the nip.

In addition, there is known a transfer device that includes a plurality of rollers and a support portion, wherein the plurality of rollers are candidates for the transfer roller, and the support portion is configured to rotate while supporting the plurality of rollers. The support portion is rotationally driven so that the transfer roller is switched among the plurality of rollers.

SUMMARY

A transfer device according to an aspect of the present disclosure includes a first roller and a second roller, a first roller support member, a second roller support member, a first displacement member, a first elastic member, a second elastic member, a second displacement member, and a driving device. Each of the first roller and the second roller is configured to be placed at a contact position to form a nip between itself and a surface of an image carrier carrying a toner image and acts as a transfer roller that transfers the toner image from the image carrier to a sheet passing through the nip. The first roller support member rotationally supports the first roller and includes a first projection portion that projects along a width direction that intersects a direction of the sheet passing through the nip. The second roller support member rotationally supports the second roller and includes a second projection portion that projects along the width direction. The first displacement member supports the first roller support member and the second roller support member such that each of the first roller support member and the second roller support member is approachable to and separable from the image carrier, and is supported in such a way as to be displaced between a first position and a second position, wherein when the first displacement member is at the first position, the first roller faces the contact position, and when the first displacement member is at the second position, the second roller faces the contact position. The first elastic member elastically biases the first roller support member toward the image carrier. The second elastic member elastically biases the second roller support member toward the image carrier. The second displacement member is supported in a displaceable manner and includes a slide portion that slides against the first projection portion and the second projection portion during a displacement of the second displacement member. The driving device is configured to switch a device state between a first operation state and a second operation state by displacing the second displacement member in a first direction and in a second direction, the first operation state being a state where the first roller is held at the contact position by the first elastic member, the second operation state being a state where the second roller is held at the contact position by the second elastic member, the first direction being a direction in which the slide portion is displaced from the first projection portion toward the second projection portion, the second direction being a direction opposite to the first direction. The slide portion includes two locking portions and a recessed portion. Each of the two locking portions is configured to lock the first projection portion and the second projection portion and thereby hold, against biasing forces of the first elastic member and the second elastic member, the first roller support member and the second roller support member at retracted positions that are separated from the image carrier. The recessed portion is formed between the two locking portions such that either the first projection portion or the second projection portion can be inserted in the recessed portion. When the first projection portion is inserted in the recessed portion, a holding of the first roller support member at the retracted position by a lock of the first projection portion is released, and when the second projection portion is inserted in the recessed portion, a holding of the second roller support member at the retracted position by a lock of the second projection portion is released. The device state is the first operation state when the first displacement member is at the first position, the first projection portion is inserted in the recessed portion, and the second projection portion is locked to a first locking portion that is one of the two locking portions. The device state is the second operation state when the first displacement member is at the second position, the second projection portion is inserted in the recessed portion, and the first projection portion is locked to a second locking portion that is another one of the two locking portions. The device state becomes the second operation state when a following procedure is performed: when the device state is the first operation state, the driving device displaces the second displacement member in the first direction to displace the second locking portion to a position to lock the first projection portion and the second projection portion, while the first displacement member is held at the first position; the driving device then displaces the second displacement member in the second direction and stops the second displacement member, allowing the first displacement member to be displaced from the first position to the second position in conjunction with a displacement of the second displacement member in a state where the first projection portion and the second projection portion are integrated with the slide portion by the biasing forces of the first elastic member and the second elastic member; and the second displacement member is further displaced and stopped at a position where the second projection portion is inserted in the recessed portion. The device state becomes the first operation state when a following procedure is performed: when the device state is the second operation state, the driving device displaces the second displacement member in the second direction to displace the second locking portion to a position to lock the first projection portion and the second projection portion while the first displacement member is held at the second position; the driving device then displaces the second displacement member in the first direction and stops the second displacement member, allowing the first displacement member to be displaced from the second position to the first position in conjunction with a displacement of the second displacement member in a state where the first projection portion and the second projection portion are integrated with the slide portion by the biasing forces of the first elastic member and the second elastic member; and the second displacement member is further displaced and stopped at a position where the first projection portion is inserted in the recessed portion.

An image forming apparatus according to another aspect of the present disclosure includes: a toner image forming device that forms a toner image on a surface of an image carrier; and the transfer device that transfers the toner image to a sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
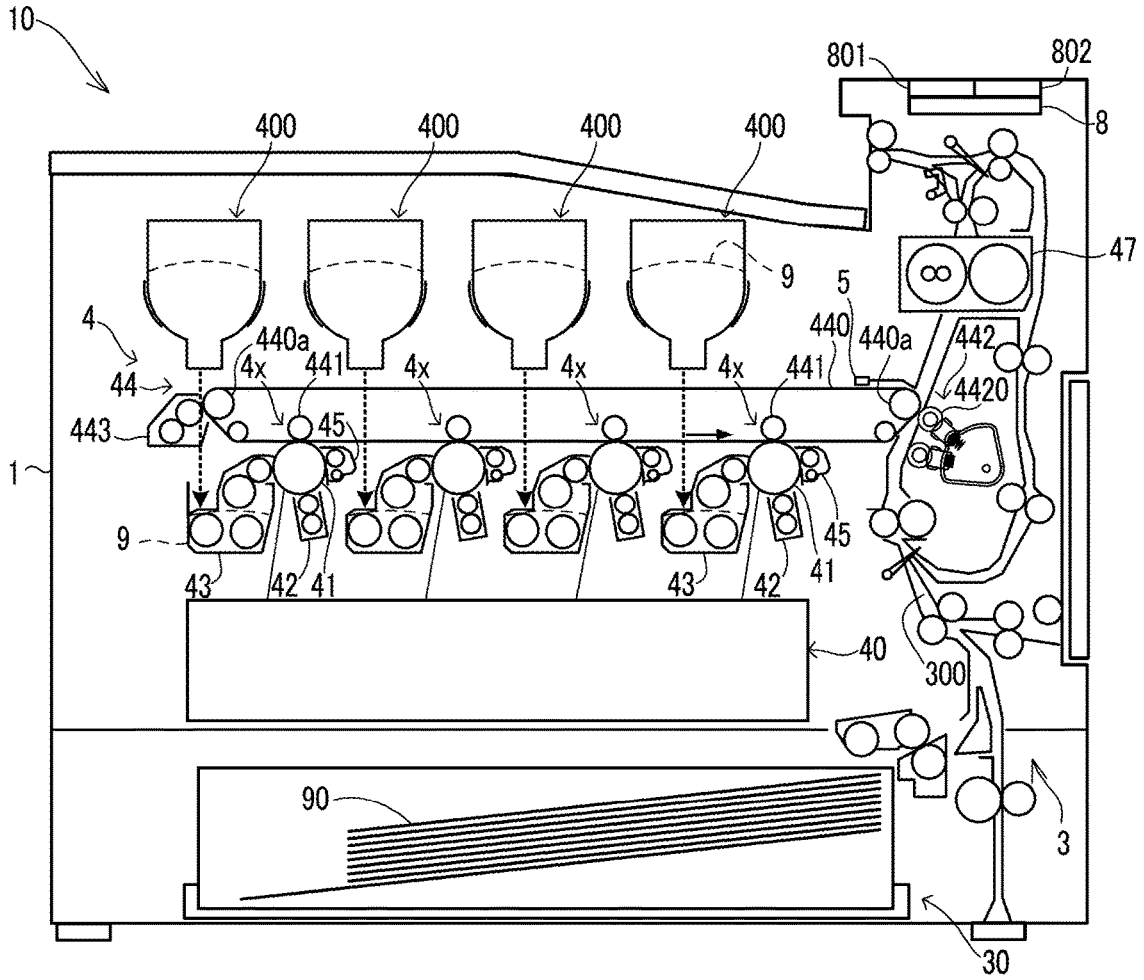
FIG. 1 is a configuration diagram of an image forming apparatus according to an embodiment.

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

An image forming apparatus 10 of the present embodiment forms an image on a sheet by an electrophotographic method. The sheet is a sheet-like image formation medium such as a sheet of paper or a resin film.

The image forming apparatus 10 includes a sheet feed device 30, a sheet conveying device 3, a print device 4, and one or more toner containers 400 that are stored in a main body 1.

The sheet feed device 30 stores a plurality of sheets and feeds the sheets one by one to a sheet conveyance path 300. The sheet conveying device 3 conveys the sheets along the sheet conveyance path 300.

The print device 4 executes a print process to form a toner image on a sheet supplied from the sheet feed device 30 and conveyed thereto by the sheet conveying device 3.

The print device 4 includes a laser scanning unit 40, one or more image creating devices 4*x*, a transfer device 44, and a fixing device 47.

In the example shown in FIG. 1, the print device 4 is a color print device of a tandem type. As a result, the print device includes four toner containers 400 and four image creating devices 4*x* that respectively correspond to four colors of toner 9. Each of the image creating devices 4*x* includes a drum-like photoconductor 41, a charging device 42, a developing device 43, and a primary cleaning device 45.

In each of the image creating devices 4*x*, the photoconductor 41 rotates, the charging device 42 electrically charges the surface of the photoconductor 41. Furthermore, in each of the image creating devices 4*x*, the laser scanning unit 40 forms an electrostatic latent image on the surface of the photoconductor 41, and the developing device 43 develops the electrostatic latent image as a toner image.

Furthermore, the transfer device 44 includes an intermediate transfer belt 440, four primary transfer devices 441, a secondary transfer device 442, and a secondary cleaning device 443. The intermediate transfer belt 440 is rotationally supported by a pair of belt support rollers 440*a*.

The intermediate transfer belt 440 rotates while in contact with the four photoconductors 41, and the four primary transfer devices 441 transfer the toner images from the four photoconductors 41 to the intermediate transfer belt 440.

The secondary transfer device 442 transfers the toner images from the intermediate transfer belt 440 to a sheet that is being conveyed in the sheet conveyance path 300. In the present embodiment, the photoconductors 41 and the intermediate transfer belt 440 are examples of an image carrier.

As described above, in the print device 4, the image creating devices 4*x*, the laser scanning unit 40, and the primary transfer devices 441 are included in an example of a toner image forming device that forms toner images on the surfaces of the photoconductors and the intermediate transfer belt. The secondary transfer device 442 transfers the toner images from the surface of the intermediate transfer belt 440 to a sheet.

The secondary cleaning device 443 removes waste toner from the intermediate transfer belt 440. In addition, in each of the image creating devices 4*x*, the primary cleaning device 45 removes remaining waste toner from the surface of the photoconductor 41.

The fixing device 47 fixes the toner image on the sheet to the sheet by heating and pressurizing the toner image. The sheet conveying device 3 discharges the sheet on which an image has been formed, from the sheet conveyance path 300.

The toner containers 400 supply the toner 9 to the corresponding developing devices 43 in the print device 4.

The image forming apparatus 10 further includes a control device 8, an operation receiver 801, and a display device 802. The display device 802 is, for example, a touch panel or an operation button configured to receive a human operation. The display device 802 is, for example, a liquid crystal panel unit configured to display information.

Figure 2:
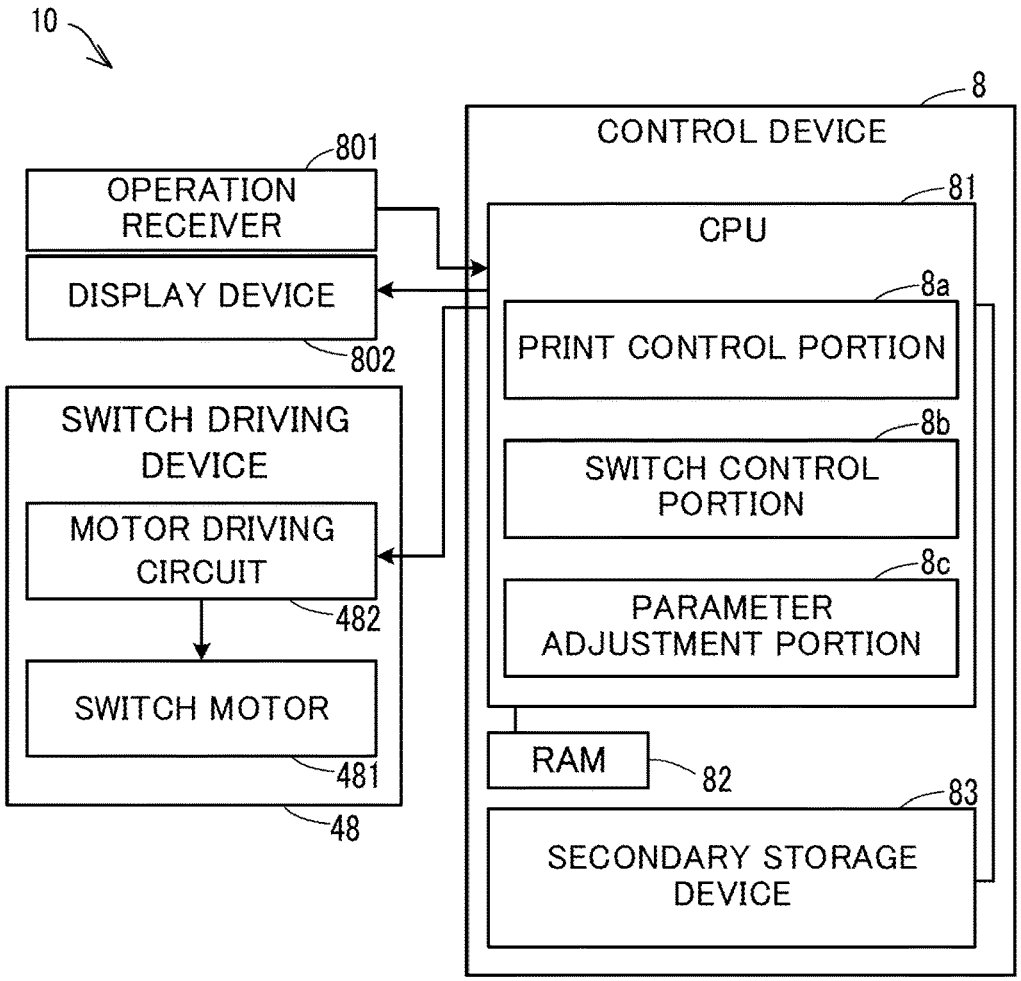
FIG. 2 is a block diagram showing a configuration of control-related devices in the image forming apparatus according to the embodiment.

As shown in FIG. 2, the control device 8 includes a CPU (Central Processing Unit) 81, a RAM (Random Access Memory) 82, and a secondary storage device 83.

The CPU 81 is an example of a processor that controls electric devices and executes various types of data processing in the image forming apparatus 10 by executing computer programs stored in the secondary storage device 83 or the like.

The CPU 81 includes a plurality of processing modules that are implemented when the computer programs are executed. The plurality of processing modules include a print control portion 8*a*, a switch control portion 8*b*, and a parameter adjustment portion 8*c*.

The print control portion 8*a* controls the print device 4 to execute the print process. The switch control portion 8*b* and the parameter adjustment portion 8*c* are described below.

It is noted that another processor such as a DSP (Digital Signal Processor) may execute various types of controls and data processing in place of the CPU 81.

The RAM 82 is a storage device configured to primarily store: the programs executed by the CPU 81; and data that is output or consulted by the CPU 81 during execution of the programs.

The secondary storage device 83 is a computer-readable nonvolatile data storage device. The secondary storage device 83 is configured to store the programs and various types of data. For example, either a hard disk drive or a SSD (Solid State Drive), or a combination thereof is adopted as the secondary storage device 83.

Figure 3:
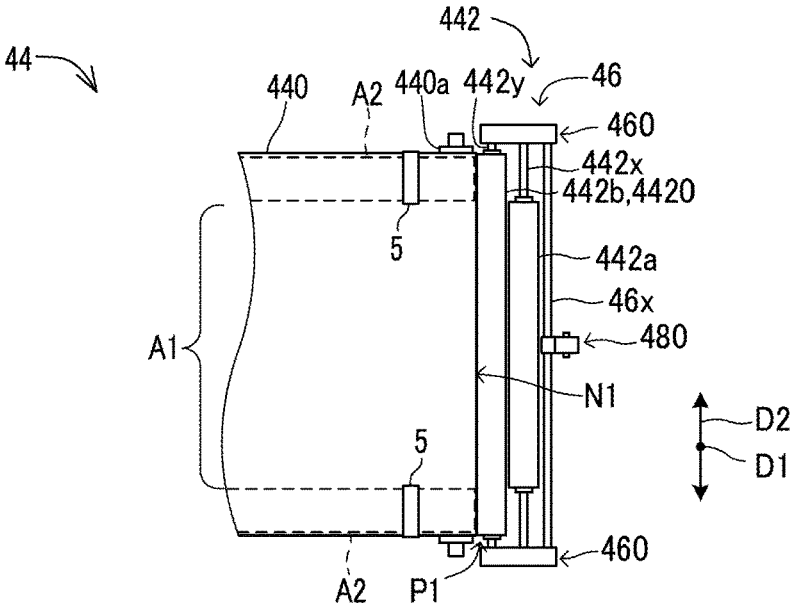
FIG. 3 is a schematic plan diagram of a main part of a transfer device in the image forming apparatus according to the embodiment.

As shown in FIG. 3, the secondary transfer device 442 includes a first roller 442*a*, a second roller 442*b*, and a roller switching mechanism 46, wherein the first roller 442*a* and the second roller 442*b* are candidates for a transfer roller 4420.

The roller switching mechanism 46 rotationally supports the first roller 442*a* and the second roller 442*b*, and selectively causes either the first roller 442*a* or the second roller 442*b*, as the transfer roller 4420, to come in contact with the intermediate transfer belt 440.

In FIG. 3 to FIG. 7, a sheet passing direction D1 is a direction in which the sheet passes through a nip N1, and a width direction D2 is a direction intersecting the sheet passing direction D1. In the present embodiment, the width direction D2 is a horizontal direction orthogonal to the sheet passing direction D1.

Figure 4:
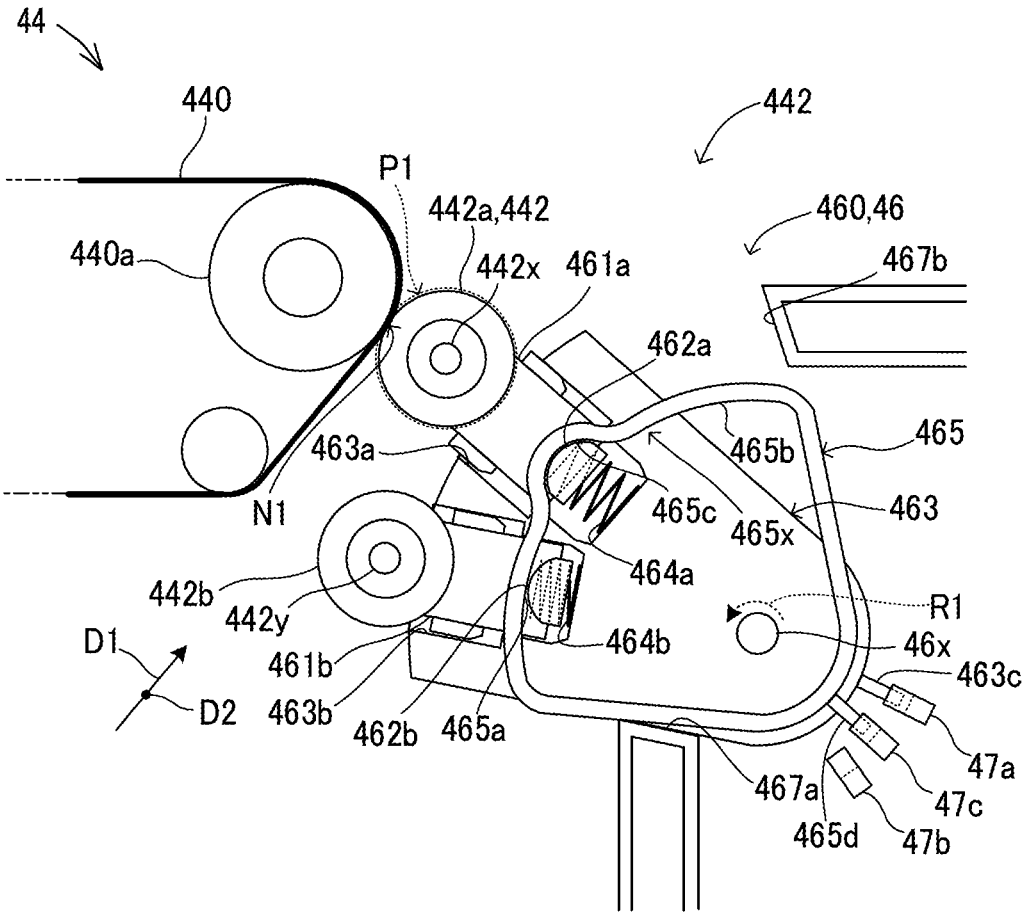
FIG. 4 is a diagram showing the transfer device in a first operation state in the image forming apparatus according to the embodiment.

As shown in FIG. 4, either the first roller 442*a* or the second roller 442*b* is placed at a contact position P1 to form the nip N1 between the placed roller and the surface of the intermediate transfer belt 440 carrying a toner image, and the placed roller acts as the transfer roller 4420 that transfers the toner image from the intermediate transfer belt 440 to a sheet passing through the nip N1.

FIG. 4 shows a state where the second roller 442*b* is placed at the contact position P1. In the present embodiment, the second roller 442*b* forms the nip N1 that is longer in the width direction D2 than the nip N1 formed by the first roller 442*a*.

In other words, the first roller 442*a* forms the nip N1 that is shorter in the width direction D2 than the nip N1 formed by the second roller 442*b*.

Hereinafter, an area of the surface of the intermediate transfer belt 440 that comes in contact with the first roller 442*a* placed at the contact position P1 is referred to as a first area A1, and areas located on both sides of the first area A1 in the width direction D2 are referred to as second areas A2.

The second areas A2 are an example of a non-contact area of the surface of the intermediate transfer belt 440 that does not come in contact with the first roller 442*a* placed at the contact position P1. In addition, the first area A1 is an example of a contact area.

When the second roller 442*b* is placed at the contact position P1, the second roller 442*b* comes in contact with both the first area A1 and the second areas A2 of the surface of the intermediate transfer belt 440.

That is, when the first roller 442*a* is placed at the contact position P1, the nip N1 is formed on the first area A1. On the other hand, when the second roller 442*b* is placed at the contact position P1, the nip N1 is formed over the first area A1 and the second areas A2 (see FIG. 3).

The image forming apparatus 10 further includes an image sensor 5 that reads images of the second areas A2 from the surface of the intermediate transfer belt 440. For example, the image sensor 5 may be a CIS (Contact Image Sensor). The image sensor 5 is an example of an image reading portion.

As described below, when the print process is performed in a state where the first roller 442*a* is placed at the contact position P1, the image forming apparatus 10 performs a parameter adjustment process in parallel to the print process.

In the parameter adjustment process, a test image is formed in the second areas A2 of the surface of the intermediate transfer belt 440, the image sensor 5 reads the test image, and a predetermined image creation parameter for the print device 4 is adjusted based on the test image read by the image sensor 5.

In the parameter adjustment process, the print control portion 8*a* causes the laser scanning unit 40 and the image creating devices 4*x* to execute a process to form the test image on the second areas A2 of the surface of the intermediate transfer belt 440. In addition, the parameter adjustment portion 8*c* causes the image sensor 5 to read the test image, and adjusts the image creation parameter.

Meanwhile, when the switching of the transfer roller 4420 between the first roller 442*a* and the second roller 442*b* is performed, it is desirable that rubbing of the first roller 442*a* and the second roller 442*b* against the transfer roller 4420 does not occur. That is, it is desirable that the switching is performed in the following sequence of steps: one roller that is in contact with the intermediate transfer belt 440 is separated from the intermediate transfer belt 440; the other roller is moved to a position facing the intermediate transfer belt 440; and the other roller is moved close to the intermediate transfer belt 440.

In usual cases, to achieve the above-described sequence of steps, two individual driving sources are required: one for separating the plurality of rollers 442*a* and 442*b* from the intermediate transfer belt 440; and another one for selectively moving one of the plurality of rollers 442*a* and 442*b* to a position facing the intermediate transfer belt 440.

On the other hand, it is desirable that the switching of the transfer roller 4420 is performed with the smallest possible number of driving sources.

In the image forming apparatus 10, the secondary transfer device 442 is configured to cause the roller switching mechanism 46 to operate using one driving source to switch the transfer roller 4420 while preventing the transfer roller 4420 from rubbing against the intermediate transfer belt 440. The following describes the configuration thereof.

[Configuration of Roller Switching Mechanism 46]

The roller switching mechanism 46 includes a pair of movable support portions 460 and a drive shaft 46*x* (see FIG. 3). The pair of movable support portions 460 rotationally support: opposite end portions of a rotation shaft 442*x* of a first roller support member 461*a*; and opposite end portions of a rotation shaft 442*y* of a second roller support member 461*b*.

As shown in FIG. 4 to FIG. 7, each of the movable support portions 460 includes the first roller support member 461*a*, the second roller support member 461*b*, a first displacement member 463, a first spring 464*a*, a second spring 464*b*, and a second displacement member 465.

For example, the first roller support member 461*a*, the second roller support member 461*b*, the first displacement member 463, and the second displacement member 465 are each a synthetic resin molded member.

The first roller support member 461*a* rotationally supports the first roller 442*a*. Specifically, the first roller support member 461*a* rotationally supports an end portion of the rotation shaft 442*x* of the first roller 442*a*.

Similarly, the second roller support member 461*b* rotationally supports the second roller 442*b*. Specifically, the second roller support member 461*b* rotationally supports an end portion of the rotation shaft 442*y* of the second roller 442*b*.

The first roller support member 461*a* includes a first projection portion 462*a* that projects along the width direction D2. Similarly, the second roller support member 461*b* includes a second projection portion 462*b* that projects along the width direction D2.

The drive shaft 46*x* is arranged along the width direction D2 and is rotationally supported. The drive shaft 46*x* is an example of a shaft member. The drive shaft 46*x* is made of a metal such as iron.

The first displacement member 463 is swingably supported by the drive shaft 46*x*. This allows the first displacement member 463 to swing around the drive shaft 46*x*. The secondary transfer device 442 further includes a first restriction portion 467*a* and a second restriction portion 467*b* that restricts the swing range of the first displacement member 463.

When the first displacement member 463 is located at a predetermined first position, the first restriction portion 467*a* abuts on the first displacement member 463 and thereby restricts the swing range of the first displacement member 463 in a first rotation direction R1 up to the first position. FIG. 4 shows a state where the first displacement member 463 is located at the first position.

Figure 6:
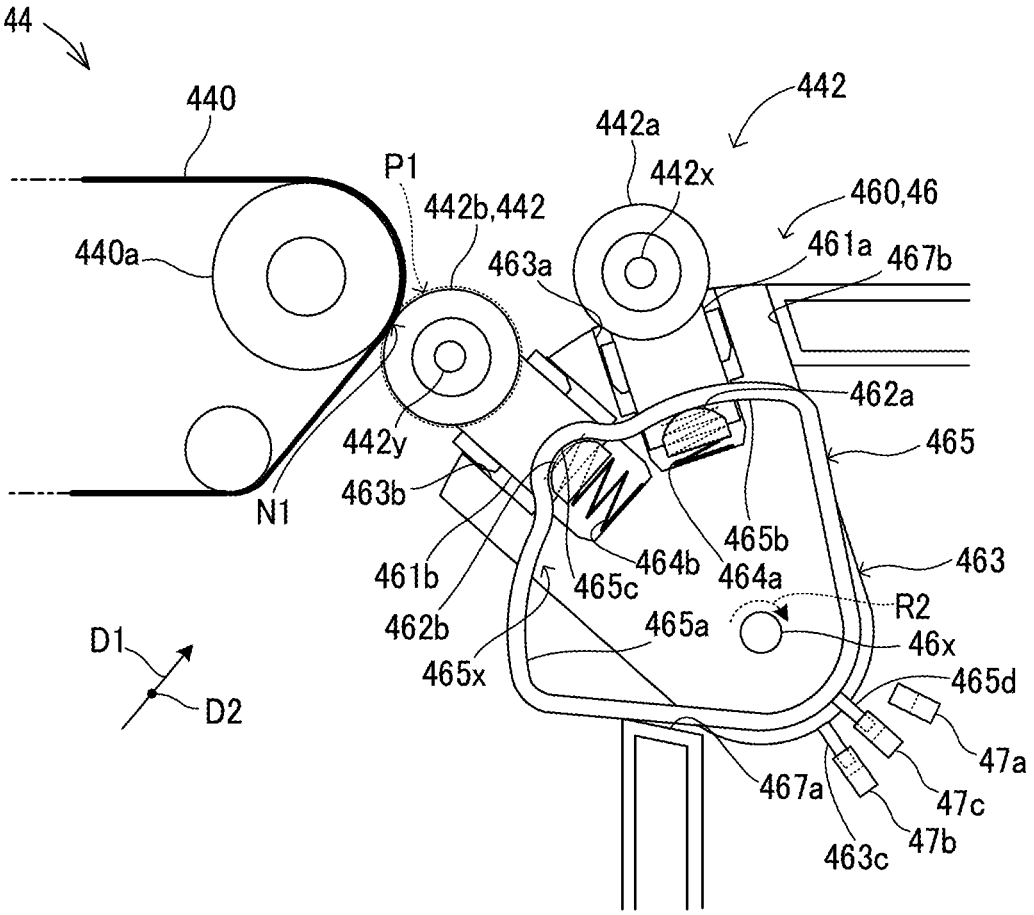
FIG. 6 is a diagram showing the transfer device in the second operation state in the image forming apparatus according to the embodiment.

When the first displacement member 463 is located at a predetermined second position, the second restriction portion 467*b* abuts on the first displacement member 463 and thereby restricts the swing range of the first displacement member 463 in a second rotation direction R2 up to the second position. FIG. 6 shows a state where the first displacement member 463 is located at the second position.

As described above, the first displacement member 463 is supported by the drive shaft 46*x* in such a way as to be displaced between the first position and the second position around the drive shaft 46*x*. In other words, the first displacement member 463 is supported by the drive shaft 46*x* in such a way as to be swingable around the drive shaft 46*x* between the first position and the second position.

In addition, the first displacement member 463 supports the first roller support member 461*a* and the second roller support member 461*b* such that each of the first roller support member 461*a* and the second roller support member 461*b* is approachable to and separable from the intermediate transfer belt 440. The first displacement member 463 supports the first roller support member 461*a* and the second roller support member 461*b* in a state where they are aligned in a direction in which the first displacement member 463 is displaced.

Specifically, the first displacement member 463 includes a first slide support portion 463*a* that supports the first roller support member 461*a* such that the first roller support member 461*a* slides along a direction perpendicular to the drive shaft 46*x*. The first slide support portion 463*a* supports the first roller support member 461*a* such that the first roller support member 461*a* is approachable to and separable from the intermediate transfer belt 440.

Furthermore, the first displacement member 463 includes a second slide support portion 463*b* that supports the second roller support member 461*b* such that the second roller support member 461*b* slides along a direction perpendicular to the drive shaft 46*x*. The second slide support portion 463*b* supports the second roller support member 461*b* such that the second roller support member 461*b* is approachable to and separable from the intermediate transfer belt 440.

As shown in FIG. 4, when the first roller 442*a* supported by the first slide support portion 463*a* faces the contact position P1, the first displacement member 463 is located at the first position. As shown in FIG. 6, when the second roller 442*b* supported by the second slide support portion 463*b* faces the contact position P1, the first displacement member 463 is located at the second position.

The first spring 464*a* is an example of a first elastic member that elastically biases the first roller support member 461*a* toward the intermediate transfer belt 440. The second spring 464*b* is an example of a second elastic member that elastically biases the second roller support member 461*b* toward the intermediate transfer belt 440.

The second displacement member 465 is integrally provided with the drive shaft 46*x*, and swings around the drive shaft 46*x* in conjunction with a rotation of the drive shaft 46*x*. That is, the second displacement member 465 is supported by the drive shaft 46*x* in such a way as to be displaced around the drive shaft 46*x*.

The second displacement member 465 includes a slide portion 465*x*. When the second displacement member 465 is displaced around the drive shaft 46*x*, the slide portion 465*x* slides against surfaces of the first projection portion 462*a* and the second projection portion 462*b* on the side of the intermediate transfer belt 440.

One direction in which the first displacement member 463 and the second displacement member 465 are displaced is the first rotation direction R1, and the other direction in which the first displacement member 463 and the second displacement member 465 are displaced is the second rotation direction R2.

The first rotation direction R1 is an example of a first direction in which the slide portion 465*x* is displaced from the first projection portion 462*a* toward the second projection portion 462*b*. The second rotation direction R2 is an example of a second direction that is opposite to the first direction. The second rotation direction R2 is a direction in which the slide portion 465*x* is displaced from the second projection portion 462*b* toward the first projection portion 462*a*.

The slide portion 465*x* includes two locking portions 465*a* and 465*b* and a recessed portion 465*c*. The two locking portions 465*a* and 465*b* are a first locking portion 465*a* and a second locking portion 465*b*.

Each of the two locking portions 465*a* and 465*b* is configured to lock the first projection portion 462*a* and the second projection portion 462*b* and thereby hold, against the biasing forces of the first spring 464*a* and the second spring

Figure 5:
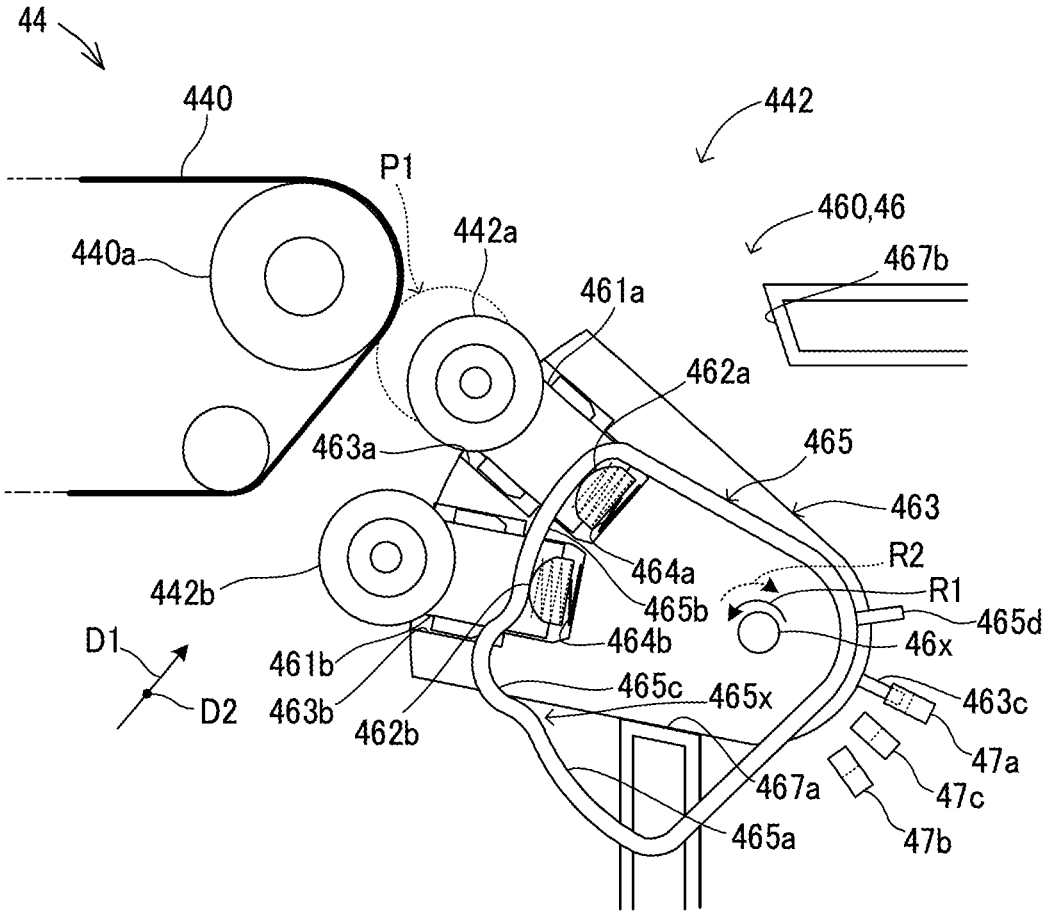
FIG. 5 is a diagram showing the transfer device in the middle of switching from the first operation state to a second operation state in the image forming apparatus according to the embodiment.
Figure 7:
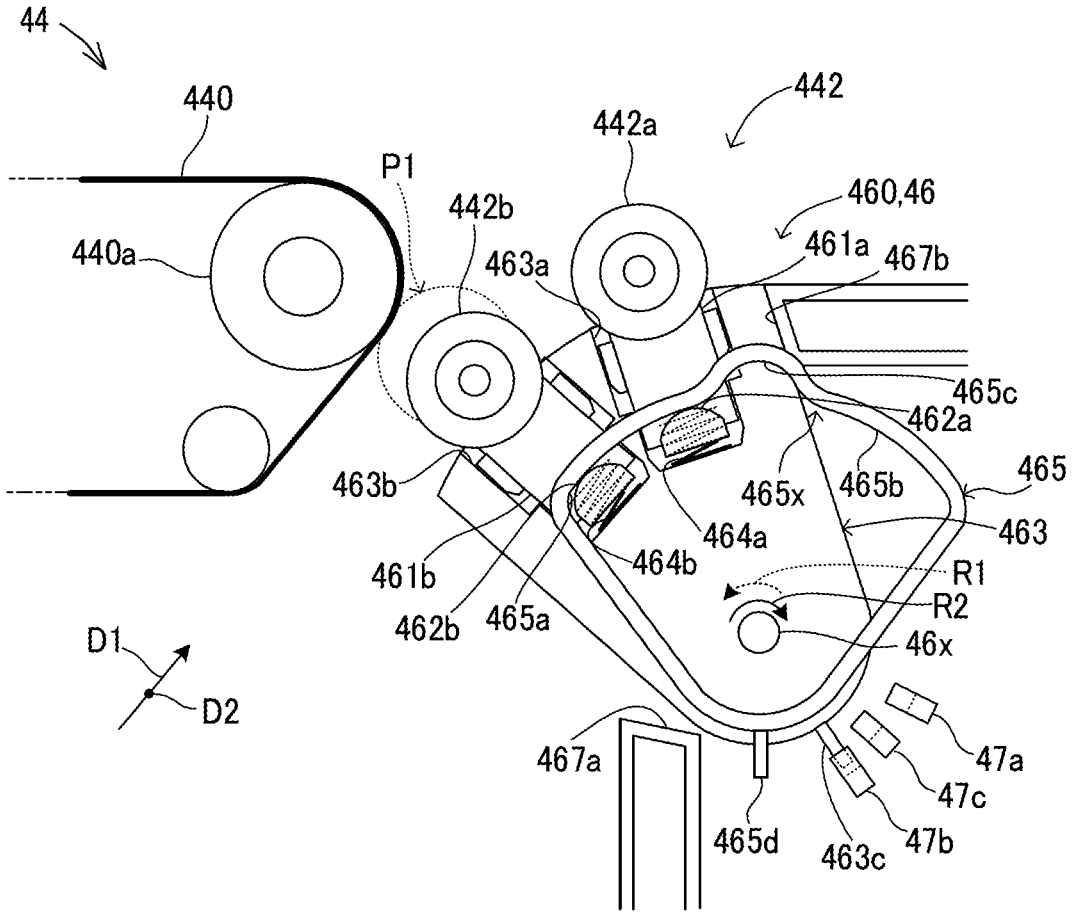
FIG. 7 is a diagram showing the transfer device in the middle of switching from the second operation state to the first operation state in the image forming apparatus according to the embodiment.

464*b*, the first roller support member 461*a* and the second roller support member 461*b* at retracted positions that are separated from the intermediate transfer belt 440 (see FIG. 5, FIG. 7).

The recessed portion 465*c* is formed between the two locking portions 465*a* and 465*b*, and either the first projection portion 462*a* or the second projection portion 462*b* can be inserted in the recessed portion 465*c* (see FIG. 4, FIG. 6).

When the first projection portion 462*a* is inserted in the recessed portion 465*c*, the holding of the first roller support member 461*a* at the retracted position by the lock of the first projection portion 462*a* is released (see FIG. 4). Similarly, when the second projection portion 462*b* is inserted in the recessed portion 465*c*, the holding of the second roller support member 461*b* at the retracted position by the lock of the second projection portion 462*b* is released (see FIG. 6).

A device state of the secondary transfer device 442 where, as shown in FIG. 4, the first roller 442*a* is held at the contact position P1 by the first spring 464*a* is referred to as a first operation state.

On the other hand, a device state of the secondary transfer device 442 where, as shown in FIG. 6, the second roller 442*b* is held at the contact position P1 by the second spring 464*b* is referred to as a second operation state.

As shown in FIG. 4 and FIG. 6, both when the device state is the first operation state and the device state is the second operation state, the second displacement member 465 is located at the same position. Hereinafter, the position of the second displacement member 465 when the device state is the first operation state or the second operation state is referred to as a reference position.

As shown in FIG. 4, the device state is the first operation state when the first displacement member 463 is at the first position, the first projection portion 462*a* is inserted in the recessed portion 465*c*, and the second projection portion 462*b* is locked to the first locking portion 465*a*.

As shown in FIG. 6, the device state is the second operation state when the first displacement member 463 is at the second position, the second projection portion 462*b* is inserted in the recessed portion 465*c*, and the first projection portion 462*a* is locked to the second locking portion 465*b*.

The secondary transfer device 442 further includes a switch driving device 48 that displaces the second displacement member 465 in the first rotation direction R1 and the second rotation direction R2 (see FIG. 2). The switch driving device 48 includes a switch motor 481 and a motor driving circuit 482 (see FIG. 2). The switch driving device 48 further includes a gear mechanism 480 (see FIG. 3).

The motor driving circuit 482 rotates the switch motor 481 in a predetermined forward rotation direction or in a reverse rotation direction in accordance with a control command from the switch control portion 8*b* of the control device 8, wherein the reverse rotation direction is reverse to the forward rotation direction. The gear mechanism 480 transmits the rotational force of the switch motor 481 to the drive shaft 46*x*.

When the switch motor 481 rotates in the forward rotation direction, the second displacement member 465 is displaced in the first rotation direction R1. When the switch motor 481 rotates in the reverse rotation direction, the second displacement member 465 is displaced in the second rotation direction R2. That is, the switch driving device 48 displaces the second displacement member 465 in the first rotation direction R1 and the second rotation direction R2 by rotationally driving the drive shaft 46*x* in the forward rotation direction and the reverse rotation direction, respectively.

[Second Roller-Switch Process]

The following describes a second roller-switch process to switch the device state from the first operation state to the second operation state.

When the device state is the first operation state, the switch driving device 48 displaces the second displacement member 465 in the first rotation direction R1. This allows the second locking portion 465*b* to be displaced to a position at which it locks the first projection portion 462*a* and the second projection portion 462*b*, while the first displacement member 463 is held at the first position (see FIG. 5).

Hereinafter, the position of the second displacement member 465 after it has been displaced in the first rotation direction R1 until the second locking portion 465*b* locks the first projection portion 462*a* and the second projection portion 462*b*, is referred to as a first turn position.

Furthermore, after the second displacement member 465 reaches the first turn position, the switch driving device 48 displaces the second displacement member 465 in the second rotation direction R2 and stops the second displacement member 465 at the reference position.

This allows the first displacement member 463 to be displaced from the first position to the second position in conjunction with the displacement of the second displacement member 465 in a state where the first projection portion 462*a* and the second projection portion 462*b* are integrated with the slide portion 465*x* by the biasing forces of the first spring 464*a* and the second spring 464*b*, the second displacement member 465 is further displaced and stopped at a position where the second projection portion 462*b* is inserted in the recessed portion 465*c*, and the device state becomes the second operation state (see FIG. 6).

It is noted that the first projection portion 462*a* and the second projection portion 462*b* are integrated with the slide portion 465*x* by the static friction force generated between them when the first projection portion 462*a* and the second projection portion 462*b* are pressed against the slide portion 465*x* by the biasing forces of the first spring 464*a* and the second spring 464*b*.

[First Roller-Switch Process]

The following describes a first roller-switch process to switch the device state from the second operation state to the first operation state.

When the secondary transfer device 442 is in the second operation state, the switch driving device 48 displaces the second displacement member 465 in the second rotation direction R2. This allows the first locking portion 465*a* to be displaced to a position at which it locks the first projection portion 462*a* and the second projection portion 462*b*, while the first displacement member 463 is held at the second position (see FIG. 7).

Hereinafter, the position of the second displacement member 465 after it has been displaced in the second rotation direction R2 until the first locking portion 465*a* locks the first projection portion 462*a* and the second projection portion 462*b*, is referred to as a second turn position.

Furthermore, after the second displacement member 465 reaches the second turn position, the switch driving device 48 displaces the second displacement member 465 in the first rotation direction R1 and stops the second displacement member 465 at the reference position. This allows the first displacement member 463 to be displaced from the second position to the first position in conjunction with the displacement of the second displacement member 465 in a state where the first projection portion 462*a* and the second projection portion 462*b* are integrated with the slide portion 465*x* by the biasing forces of the first spring 464*a* and the second spring 464*b*, the second displacement member 465 is further displaced and stopped at a position where the first projection portion 462*a* is inserted in the recessed portion 465*c*, and the device state becomes the first operation state (see FIG. 8).

As described above, the switch driving device 48 switches the device state between the first operation state and the second operation state by displacing the second displacement member 465 in the first rotation direction R1 and the second rotation direction R2 in accordance with a control command from the switch control portion 8*b*.

With adoption of the roller switching mechanism 46 and the switch driving device 48, it is possible for one switch motor 481 to operate a mechanism to switch the transfer roller 4420 while preventing the transfer roller 4420 from rubbing against the intermediate transfer belt 440.

In the present embodiment, the first displacement member 463 of one of the pair of movable support portions 460 includes a projecting first detected portion 463*c*. In addition, the second displacement member 465 of one of the pair of movable support portions 460 includes a projecting second detected portion 465*d*.

Furthermore, the secondary transfer device 442 includes a first detection sensor 47*a*, a second detection sensor 47*b*, and a third detection sensor 47*c*. The first detection sensor 47*a* and the second detection sensor 47*b* are configured to detect the first detected portion 463*c* respectively at two predetermined positions that are passed by the first detected portion 463*c* when the first displacement member 463 is displaced.

The third detection sensor 47*c* is configured to detect the second detected portion 465*d* at a predetermined position that is passed by the second detected portion 465*d* when the second displacement member 465 is displaced.

Each of the first detection sensor 47*a*, the second detection sensor 47*b*, and the third detection sensor 47*c* may be a non-contact type object detection sensor such as a transmissive photosensor or a reflective photosensor, or a contact type object detection sensor such as a limit switch.

In the present embodiment, when the first displacement member 463 is located at the first position, the first detected portion 463*c* is detected by the first detection sensor 47*a* (see FIG. 4, FIG. 5). In addition, when the first displacement member 463 is located at the second position, the first detected portion 463*c* is detected by the second detection sensor 47*b* (see FIG. 6, FIG. 7).

That is, the first detection sensor 47*a* detects that the first displacement member 463 is located at the first position, and the second detection sensor 47*b* detects that the first displacement member 463 is located at the second position.

In addition, when the recessed portion 465*c* of the second displacement member 465 is located at a position facing the contact position P1, the second detected portion 465*d* is detected by the third detection sensor 47*c* (see FIG. 4, FIG. 6).

The second displacement member 465 is located at the reference position when the recessed portion 465*c* of the second displacement member 465 is located at the position facing the contact position P1. That is, the third detection sensor 47*c* detects that the second displacement member 465 is located at the reference position.

The switch control portion 8*b* determines the positions of the first displacement member 463 and the second displacement member 465 based on a state where the first detection sensor 47*a*, the second detection sensor 47*b*, and/or the third detection sensor 47*c* detect the first detected portion 463*c* and/or the second detected portion 465*d*, and based on an elapsed time from a time point when the third detection sensor 47*c* did not detect the second detected portion 465*d*.

Furthermore, the switch control portion 8*b* controls a direction in which the second displacement member 465 is displaced and a timing to stop the second displacement member 465, based on the detected positions of the first displacement member 463 and the second displacement member 465.

In the present embodiment, the initial state of the secondary transfer device 442 is the first operation state (see FIG. 4). When the secondary transfer device 442 is in the first operation state, the print device 4 can execute the print process on a sheet of a size equal to or smaller than a specific size that corresponds to the first area A1 of the surface of the intermediate transfer belt 440. That is, the specific size is a size of a sheet onto which the toner image can be transferred by the first roller 442*a*.

On the other hand, when the print process is executed on a sheet of a size larger than the specific size, the state of the secondary transfer device 442 needs to be switched from the first operation state to the second operation state.

[Print Control]

Figure 8:
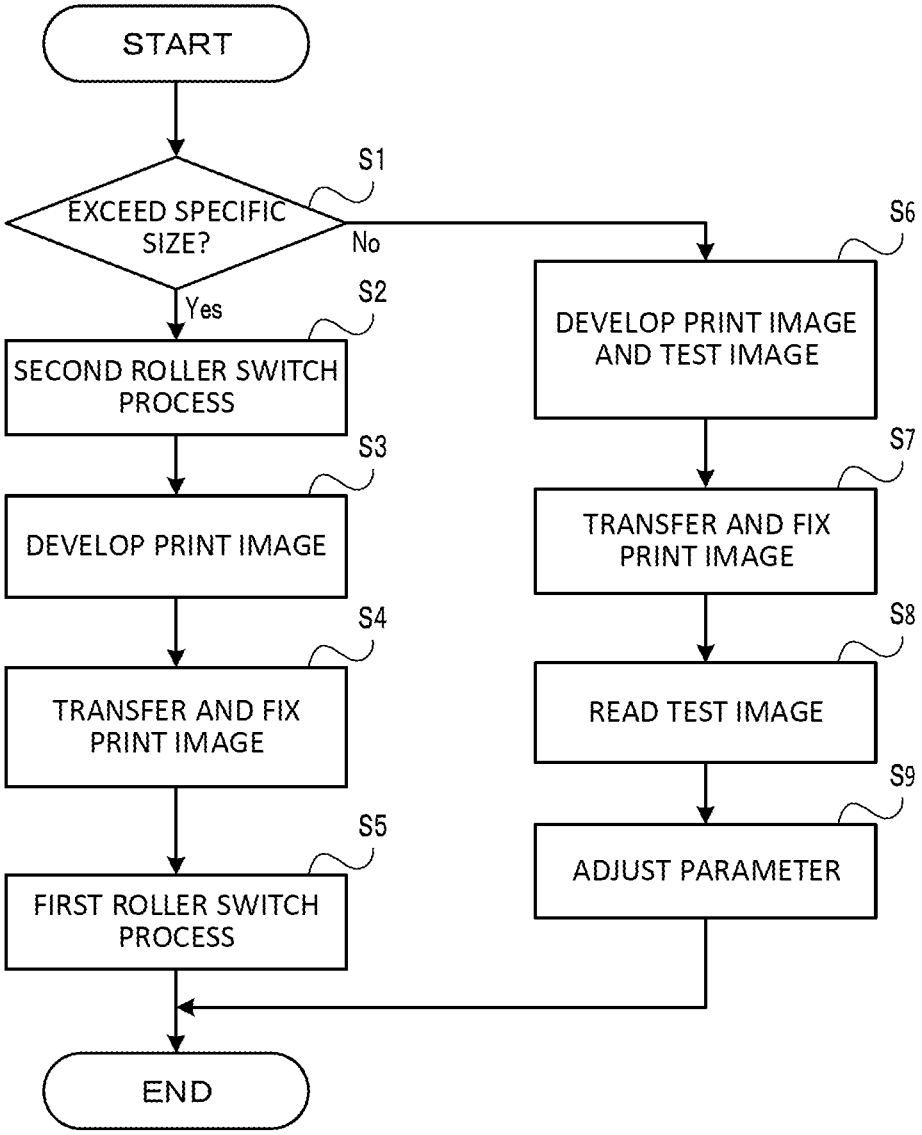
FIG. 8 is a flowchart showing an example of a procedure of a print control in the image forming apparatus according to the embodiment.

The following describes an example of a procedure of the print control executed by the print control portion 8*a*, the switch control portion 8*b*, and the parameter adjustment portion 8*c*, with reference to the flowchart shown in FIG. 8.

The print control portion 8*a* starts the print control when a print job is generated. For example, the print job is received from an information processing apparatus that is communicated with a communication device (not shown). In the following description, S1, S2, . . . are identification signs representing a plurality of steps of the print control.

<Step S1>

When the print job is generated, the print control portion 8*a* determines whether or not the size of a print target sheet exceeds the specific size. Information of the size of the sheet is included in the print job.

Upon determining that the size of the print target sheet exceeds the specific size, the print control portion 8*a* moves the process to step S2. Otherwise, the print control portion 8*a* moves the process to step S6.

<Step S2>

In step S2, the print control portion 8*a* causes the switch driving device 48 to execute the second roller-switch process to switch the state of the secondary transfer device 442 from the first operation state to the second operation state, and moves the process to step S3. The second roller-switch process is executed as described above.

<Step S3>

In step S3, the print control portion 8*a* causes the image creating devices 4*x* and the laser scanning unit 40 to execute a process of developing a print image in accordance with the print job. The print control portion 8*a* further executes a process of step S4 in parallel to the process of step S3.

With the process of step S3, the print image is formed as the toner image over the first area A1 and the second areas A2 of the surface of the intermediate transfer belt 440.

<Step S4>

In step S4, the print control portion 8*a* causes the secondary transfer device 442 and the fixing device 47 to execute a process of transferring the print image to the sheet and a process of fixing the print image to the sheet, and moves the process to step S5.

In step S4, the second roller 442*b* having a large width transfers the toner image formed over the first area A1 and the second areas A2 of the surface of the intermediate transfer belt 440 to the sheet of a size exceeding the specific size.

<Step S5>

In step S5, the switch control portion 8*b* causes the switch driving device 48 to execute the first roller-switch process to switch the state of the secondary transfer device 442 from the second operation state to the first operation state. This allows the secondary transfer device 442 to return to the initial state, and the print control ends.

<Step S6>

In step S6, the print control portion 8*a* causes the image creating devices 4*x* and the laser scanning unit 40 to execute a process to develop the print image according to the print job and develop a predetermined test image. The print control portion 8*a* further executes a process of step S7 in parallel to the process of step S6.

In step S6, the print control portion 8*a* causes the image creating devices 4*x* and the laser scanning unit 40 to execute a process to form the print image on the first area A1 of the surface of the intermediate transfer belt 440 and develop the test image on the second areas A2.

For example, the test image includes a plurality of rectangular patch images that have different combinations of color and density.

<Step S7>

In step S7, the print control portion 8*a* causes the secondary transfer device 442 and the fixing device 47 to execute a process of transferring the print image to the sheet and a process of fixing the print image to the sheet, and moves the process to step S8.

In step S7, the first roller 442*a* having a small width transfers the toner image formed on the first area A1 of the surface of the intermediate transfer belt 440 to the sheet of a size equal to or smaller than the specific size.

Accordingly, the test image formed on the second areas A2 of the surface of the intermediate transfer belt 440 remains on the surface of the intermediate transfer belt 440 without being transferred to the sheet. However, the toner 9 representing the test image is removed from the surface of the intermediate transfer belt 440 by the secondary cleaning device 443 finally.

<Step S8>

In step S8, the parameter adjustment portion 8*c* causes the image sensor 5 to execute a process to read the test image, and acquires the data of the image read by the image sensor 5. The parameter adjustment portion 8*c* then moves the process to step S9.

<Step S9>

In step S9, the parameter adjustment portion 8*c* adjusts the image creation parameter for the print device 4 based on the data of the read image acquired from the image sensor 5. This ends the print control.

For example, the parameter adjustment portion 8*c* adjusts the developing density parameter such as: a correction value of a developing bias voltage of the developing device 43; or a density correction value of the print image. The developing density parameter is an example of the image creation parameter.

In addition, the parameter adjustment portion 8*c* adjusts a timing at which the laser scanning unit 40 writes the electrostatic latent image on the photoconductor 41 of each of the image creating devices 4*x*, based on a difference between the color of the test image in the read image and a predetermined target color. The timing to write the electrostatic latent image is an example of the image creation parameter, too.

As described above, the print control portion 8*a* causes the print device 4 to execute a process to form the print image on the first area A1 and form the test image on the second areas A2 of the surface of the intermediate transfer belt 440 when the secondary transfer device 442 is in the first operation state and the print process is executed on a sheet of a size equal to or smaller than the specific size (steps S6 and S7 in FIG. 8).

In addition, the parameter adjustment portion 8*c* adjusts the image creation parameter for the print device 4 based on the state of the test image included in the image read by the image sensor 5 (step S9 in FIG. 8).

This makes it possible for the image forming apparatus 10 to adjust the image creation parameter at high frequency during execution of the print process without requiring a dedicated period for adjusting the image creation parameter.

In addition, in a case where the initial state of the secondary transfer device 442 is the first operation state, the switch control portion 8*b* causes the switch driving device 48 to switch the state of the secondary transfer device 442 from the first operation state to the second operation state before the print process starts to be performed on a sheet of a size exceeding the specific size (step S2 in FIG. 8).

Furthermore, after the print process on the sheet of the size exceeding the specific size ends, the switch control portion 8*b* causes the switch driving device 48 to switch the state of the secondary transfer device 442 from the second operation state to the first operation state (step S5 in FIG. 8).

The processes performed by the switch control portion 8*b* enable the parameter adjustment portion 8*c* to adjust the image creation parameter at high frequency.

First Application Example

In the secondary transfer device 442, the first displacement member 463 and the second displacement member 465 are supported in such a way as to be swingable around the drive shaft 46*x*. However, the first displacement member 463 may be supported by a predetermined slide support mechanism in such a way as to be slidably displaced between the first position and the second position. In this case, the second displacement member 465, too, is supported to be slidable in parallel to a direction in which the first displacement member 463 is displaced.

In addition, in a case where the second displacement member 465 is supported in such a way as to be slidably displaced, the gear mechanism 480 of the switch driving device 48 may be a rack and pinion mechanism.

Second Application Example

In addition, in the image forming apparatus 10, the second detection sensor 47*b* may be omitted. In this case, it is determined that the first displacement member 463 has been displaced from the first position to the second position, based on an elapsed time from a time point when the first detection sensor 47*a* did not detect the first detected portion 463*c*.

Third Application Example

In addition, in a case where the image forming apparatus 10 is a monochrome image forming apparatus, the structure of the secondary transfer device 442 may be applied to the primary transfer device 441. In this case, the photoconductor 41 is the image carrier that comes in contact with the first roller 442*a* or the second roller 442*b*. In addition, the image creating device 4$x$ and the laser scanning unit 40 are an example of a toner image forming device that forms the toner image on the surface of the photoconductor 41.

In the present application example, the image sensor 5 reads the test image on the second areas A2 of the surface of the photoconductor 41. In addition, the toner 9 that represents the test image on the surface of the photoconductor 41 is removed from the surface of the photoconductor 41 by the primary cleaning device 45.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A transfer device comprising:

a first roller and a second roller each of which is configured to be placed at a contact position to form a nip between itself and a surface of an image carrier carrying a toner image and acts as a transfer roller that transfers the toner image from the image carrier to a sheet passing through the nip;

a first roller support member rotationally supporting the first roller and including a first projection portion that projects along a width direction that intersects a direction of the sheet passing through the nip;

a second roller support member rotationally supporting the second roller and including a second projection portion that projects along the width direction;

a first displacement member supporting the first roller support member and the second roller support member such that each of the first roller support member and the second roller support member is approachable to and separable from the image carrier, and supported in such a way as to be displaced between a first position and a second position, wherein when the first displacement member is at the first position, the first roller faces the contact position, and when the first displacement member is at the second position, the second roller faces the contact position, a first elastic member elastically biasing the first roller support member toward the image carrier;

a second elastic member elastically biasing the second roller support member toward the image carrier;

a second displacement member supported in a displaceable manner and including a slide portion that slides against the first projection portion and the second projection portion during a displacement of the second displacement member; and a driving device configured to switch a device state between a first operation state and a second operation state by displacing the second displacement member in a first direction and in a second direction, the first operation state being a state where the first roller is held at the contact position by the first elastic member, the second operation state being a state where the second roller is held at the contact position by the second elastic member, the first direction being a direction in which the slide portion is displaced from the first projection portion toward the second projection portion, the second direction being a direction opposite to the first direction, wherein the slide portion includes:

two locking portions each of which is configured to lock the first projection portion and the second projection portion and thereby hold, against biasing forces of the first elastic member and the second elastic member, the first roller support member and the second roller support member at retracted positions that are separated from the image carrier; and a recessed portion formed between the two locking portions such that either the first projection portion or the second projection portion can be inserted in the recessed portion, when the first projection portion is inserted in the recessed portion, a holding of the first roller support member at the retracted position by a lock of the first projection portion is released, and when the second projection portion is inserted in the recessed portion, a holding of the second roller support member at the retracted position by a lock of the second projection portion is released, the device state is the first operation state when the first displacement member is at the first position, the first projection portion is inserted in the recessed portion, and the second projection portion is locked to a first locking portion that is one of the two locking portions, the device state is the second operation state when the first displacement member is at the second position, the second projection portion is inserted in the recessed portion, and the first projection portion is locked to a second locking portion that is another one of the two locking portions, the device state becomes the second operation state when a following procedure is performed: when the device state is the first operation state, the driving device displaces the second displacement member in the first direction to displace the second locking portion to a position to lock the first projection portion and the second projection portion, while the first displacement member is held at the first position; the driving device then displaces the second displacement member in the second direction and stops the second displacement member, allowing the first displacement member to be displaced from the first position to the second position in conjunction with a displacement of the second displacement member in a state where the first projection portion and the second projection portion are integrated with the slide portion by the biasing forces of the first elastic member and the second elastic member; and the second displacement member is further displaced and stopped at a position where the second projection portion is inserted in the recessed portion, and the device state becomes the first operation state when a following procedure is performed: when the device state is the second operation state, the driving device displaces the second displacement member in the second direction to displace the second locking portion to a position to lock the first projection portion and the second projection portion while the first displacement member is held at the second position; the driving device then displaces the second displacement member in the first direction and stops the second displacement member, allowing the first displacement member to be displaced from the second position to the first position in conjunction with a displacement of the second displacement member in a state where the first projection portion and the second projection portion are integrated with the slide portion by the biasing forces of the first elastic member and the second elastic member; and the second displacement member is further displaced and stopped at a position where the first projection portion is inserted in the recessed portion.

2. The transfer device according to claim 1, further comprising:

a shaft member arranged along the width direction and rotationally supported, wherein the first displacement member is supported by the shaft member in such a way as to be swingable around the shaft member between the first position and the second position, the second displacement member is integrally provided with the shaft member, and swings around the shaft member in conjunction with a rotation of the shaft member, and the driving device displaces the second displacement member in the first direction and the second direction by rotationally driving the shaft member in two rotation directions, respectively.

3. The transfer device according to claim 1, wherein the second roller forms a longer nip in the width direction than the first roller does.

4. An image forming apparatus comprising:

a toner image forming device that forms a toner image on a surface of an image carrier; and the transfer device according to claim 1 that transfers the toner image to a sheet.

5. The image forming apparatus according to claim 4, further comprising:

an image reading device that, in a case where the first roller forms a shorter nip in the width direction than the second roller does, reads an image from a non-contact area of the surface of the image carrier, wherein the non-contact area does not come in contact with the first roller;

a print control portion that causes the print device to execute a process to form a print image on a contact area of the surface of the image carrier that comes in contact with the first roller, and form a test image on the non-contact area when a state of the transfer device is the first operation state and a print process is executed on a sheet of a size equal to or smaller than a specific size to which the first roller can transfer the toner image; and a parameter adjustment portion that adjusts a predetermined image creation parameter for the print device based on an image read by the image reading device.

6. The image forming apparatus according to claim 5, further comprising:

a switch control portion that, in a case where an initial state of the transfer device is the first operation state, causes the driving device to switch the state of the transfer device from the first operation state to the second operation state before the print process starts to be performed on a sheet of a size exceeding the specific size, and after the print process on the sheet of the size exceeding the specific size ends, causes the driving device to switch the state of the transfer device from the second operation state to the first operation state.

* * * * *